US009199109B2

(12) United States Patent
Edlinger et al.

(10) Patent No.: US 9,199,109 B2
(45) Date of Patent: Dec. 1, 2015

(54) METHOD FOR PROCESSING USED CARBON-CONTAINING CATHODE MATERIAL

(71) Applicant: SGL CARBON SE, Wiesbaden (DE)

(72) Inventors: Alfred Edlinger, Bartholomaeberg (AT); Johann Daimer, Moerfelden-Walldorf (DE)

(73) Assignee: SGL CARBON SE, Wiesbaden (DE)

( * ) Notice: Subject to any disclaimer, the term of this patent is extended or adjusted under 35 U.S.C. 154(b) by 0 days.

(21) Appl. No.: 13/974,302

(22) Filed: Aug. 23, 2013

(65) Prior Publication Data

US 2013/0338421 A1 Dec. 19, 2013

Related U.S. Application Data

(63) Continuation of application No. PCT/EP2012/053006, filed on Feb. 22, 2012.

(30) Foreign Application Priority Data

Feb. 23, 2011 (AT) ..... A 245/2011

(51) Int. Cl.
*C10J 3/20* (2006.01)
*A62D 3/38* (2007.01)
(Continued)

(52) U.S. Cl.
CPC ... *A62D 3/38* (2013.01); *C10J 3/18* (2013.01); *C10J 3/22* (2013.01); *C10J 3/26* (2013.01); *C10J 3/42* (2013.01); *C10J 3/57* (2013.01); *C10K 1/003* (2013.01); *C10K 1/103* (2013.01); *F23G 5/0276* (2013.01); *F23G 5/10* (2013.01); *F23G 5/16* (2013.01); *F23G 7/003* (2013.01); *C10J 2200/156* (2013.01); *C10J 2300/0946* (2013.01); *C10J 2300/0959* (2013.01); *C10J 2300/0976* (2013.01); *C10J 2300/123* (2013.01);
(Continued)

(58) Field of Classification Search
CPC ..... C01B 3/00; A62D 3/38
USPC ..... 423/650; 252/373
See application file for complete search history.

(56) References Cited

U.S. PATENT DOCUMENTS 3,304,249 A * 2/1967 Katz ..... 204/164
5,222,448 A 6/1993 Morgenthaler et al.
(Continued)

FOREIGN PATENT DOCUMENTS

CA 2308545 11/2001
JP 2007203156 A 8/2007
WO WO 2006086874 A1 * 8/2006

*Primary Examiner* — Anthony J Zimmer
*Assistant Examiner* — Syed Iqbal
(74) *Attorney, Agent, or Firm* — Laurence Greenberg; Werner Stemer; Ralph Locher

(57) ABSTRACT

In a method for processing used cathode material containing carbon, in particular used cathode troughs from aluminum production, the cathode material is put into a shaft furnace and, in order to gasify carbon, is subjected to a thermal treatment in the shaft furnace at a temperature above the ignition temperature of the carbon and above the evaporation temperature of toxic substances contained in the used cathode material. The reaction gases are conducted co-current with the carbon in a first longitudinal section of the shaft furnace and countercurrent to the carbon in a second longitudinal section of the shaft furnace. The reaction gases are drawn from a region of the shaft furnace having an enlarged cross-section between the longitudinal sections and are preferably subjected to an after-treatment.

19 Claims, 9 Drawing Sheets

(51) Int. Cl.

| | |
|---|---|
| ***A62D 3/40*** | (2007.01) |
| ***F23G 7/00*** | (2006.01) |
| ***F23G 5/027*** | (2006.01) |
| ***F23G 5/10*** | (2006.01) |
| ***F23G 5/16*** | (2006.01) |
| ***C10J 3/18*** | (2006.01) |
| ***C10J 3/22*** | (2006.01) |
| ***C10J 3/26*** | (2006.01) |
| ***C10J 3/42*** | (2006.01) |
| ***C10J 3/57*** | (2006.01) |
| ***C10K 1/00*** | (2006.01) |
| ***C10K 1/10*** | (2006.01) |

(52) U.S. Cl.

CPC ..... *F23G 2201/301* (2013.01); *F23G 2201/303* (2013.01); *F23G 2201/701* (2013.01); *F23G 2202/20* (2013.01); *F23G 2204/204* (2013.01); *F23G 2900/50001* (2013.01)

(56) References Cited

U.S. PATENT DOCUMENTS

| | | | | |
|---|---|---|---|---|
| 6,074,623 | A * | 6/2000 | Vick et al. | 423/418.2 |
| 2008/0237944 | A1 * | 10/2008 | Konig et al. | 266/187 |

* cited by examiner

METHOD FOR PROCESSING USED CARBON-CONTAINING CATHODE MATERIAL

CROSS-REFERENCE TO RELATED APPLICATION

This is a continuation application, under 35 U.S.C. §120, of copending international application No. PCT/EP2012/053006, filed Feb. 22, 2012, which designated the United States; this application also claims the priority, under 35 U.S.C. §119, of Austrian patent application No. A 245/2011, filed Feb. 23, 2011; the prior applications are herewith incorporated by reference in their entireties.

BACKGROUND OF THE INVENTION

Field of the Invention

The invention relates to a method for processing used carbon-containing cathode material, in particular used cathode troughs from aluminum production, in which the cathode material is placed in a shaft furnace and, in order to gasify carbon, is subjected to a thermal treatment in the shaft furnace at a temperature above the ignition temperature of the carbon and above the evaporation temperature of toxic substances contained in the used cathode material.

In aluminum production according to the Hall-Heroult process, aluminum oxide is reduced during molten mass electrolysis. The electrolysis cell most often is comprised of a steel trough clad with carbon material (graphite/anthracite) and a refractory material, such as fireclay. The carbon cladding serves as the cathode during electrolysis, and as such will subsequently be referred to as a cathode trough. Used cathode troughs, also called spent potliners, accumulate in large quantities during aluminum production according to the Hall-Heroult process, and have always posed problems relating to disposal due to their high content of toxic substances. The toxic substances include cyanide, which forms out of the carbon in the cathode troughs and nitrogen in the air, and various metal fluorides, such as sodium and aluminum fluoride, which are formed out of the metal species contained in the bauxite in conjunction with the fluoride of the cryolite used in the Hall-Heroult process. When changing out the used cathode troughs, the latter are removed from the electrolysis cell together with a refractory encircling wall, so that the spent potliners cleaned in this way predominantly still contain aluminum, silicon, calcium and magnesium oxide from the refractory material.

For example, a method of the kind mentioned at the outset became known from Canadian patent application CA 2 308 545 A1, corresponding to U.S. Pat. No. 6,074,623. In this method, used cathode troughs from aluminum production are gassed in a shaft furnace, and the formed reaction gasses are removed. However, the disadvantage to the process according to this prior art is that the alkali metals also contained in the used cathode troughs tend to form circuits in such shaft furnaces, thereby becoming concentrated in the shaft furnace, and leading to accretions and slopes in conjunction with elevated refractory wear and dust emission, and to a diminished quality for potentially formed slag from the starting materials.

SUMMARY OF THE INVENTION

Therefore, the object of the present invention is to indicate an improved method with which the mentioned toxic substances can be completely separated and obtained from the used cathode material, while at the same time preventing the formation of alkali circuits.

In order to achieve the object, the method mentioned at the outset is developed further according to the invention so that the reaction gases are conducted co-currently with the carbon in a first longitudinal section of the shaft furnace, and counter-currently to the carbon in a second longitudinal section of the shaft furnace. The reaction gases are drawn from a region of the shaft furnace having an enlarged cross section, in particular an enlarged diameter, between the specified longitudinal sections, and preferably subjected to an after-treatment. Because the reaction gases are drawn in a central area along the longitudinal axis of the shaft furnace (central gas vent), alkali circuits are interrupted, and the reaction gases containing the mentioned toxic substances in the form of sodium fluoride (NaF), aluminum fluoride ($AlF_3$), hydrofluoric acid (HF), nitrogen ($N_2$) and potentially additional alkaline and alkaline earth fluorides in addition to synthesis gas ($CO+H_2$) can be relayed to further reprocessing.

The process itself takes place autothermally due to the high carbon content once the carbon has reached the ignition temperature and enough oxygen is available for gassing purposes. However, in order to initiate the process or provide support during the process, another embodiment envisages that the furnace be heated to heat the carbon of the used cathode material to the reaction temperature. This heating can basically be conducted in any of the ways known to the expert. In one embodiment, for example, the energy for thermal treatment can be introduced into the carbon to be reprocessed via electric induction. In this case, induction coils can be arranged around the periphery of the shaft furnace in the area of the dispensing end of the shaft furnace, and used to build up an induction field to which the introduced carbon of the used cathode material becomes coupled, and thereby heated. According to an alternative embodiment to the above, heating can also be accomplished through fossil firing, for example by positioning a combustion chamber in the shaft furnace, preferably in the first longitudinal section of the shaft furnace, and in particular in the upper region of the first longitudinal section, by which the shaft furnace has introduced into it a fuel, such as natural gas, petroleum, coal dust, dust generated by used cathode troughs or the like, optionally mixed in with an oxidation gas, such as oxygen or air. In another variant of this embodiment, a supply line that empties into the first longitudinal section of the shaft furnace, preferably into the upper region of the first longitudinal section of the shaft furnace, can be provided, through which the shaft furnace is supplied with fuel, optionally mixed in with oxidation gas. In another variant of this embodiment, the first longitudinal section of the shaft furnace, preferably the upper region of the first longitudinal section of the shaft furnace, can incorporate one or more lances that preferably extend in the direction of the longitudinal extension of the shaft furnace, through which the shaft furnace is supplied with fuel and oxidation gas, either separately or mixed together. As an alternative to heating via induction or fossil firing, the carbon of the used carbon-containing cathode material can also be brought to the reaction temperature by placing a partial quantity of already incandescent coke or graphite on the used cathode material introduced into the shaft furnace, or by adding a partial quantity of already incandescent coke or graphite to the used cathode material during or before its introduction into the shaft furnace.

The present invention is basically not limited with respect to either the absolute or relative dimensions of the individual longitudinal sections. However, especially good results are obtained when the length of the first longitudinal section measures 40 to 80%, preferably 50 to 70%, and especially preferably 60 to 70% of the overall length of the shaft furnace.

A further development of the inventive idea proposes that the length of the second longitudinal section preferably measure 20 to 60%, especially preferably 30 to 50%, and eminently preferably 30 to 40% of the overall length of the shaft furnace.

The shaft furnace or its longitudinal sections can here exhibit a circular cross section. However, a rectangular cross section is preferred for inductively heated shaft furnaces. This is preferred in particular in light of the skin effect, which ends up limiting the penetration depth of the electrodynamic field.

In order to maintain the carbonization of the carbon, a preferred embodiment of the present invention provides that oxygen be blown into the first and/or second longitudinal section of the shaft furnace. In regions where the oxygen hits the carbon heated at least to ignition temperature, the carbon is oxidized to $CO_2$, but the latter is again reduced to CO in the carbon fill in the shaft furnace, thereby satisfying Boudouard's equilibrium. As a result, the carbon is not completely burned, but merely gassed, so that carbon monoxide with a calorific value can be obtained. Under the prevailing reaction conditions, the cyanide ($CN^-$ compound) contained in the used cathode material is also converted into carbon monoxide and nitrogen, and thereby completely destroyed.

In order to separate out alkali metals, their compounds and fluoride, the method according to the invention is preferably further developed in such a way that water or steam is blown into the first and/or second longitudinal section of the shaft furnace. Fluorides and alkali compounds, for example those present as sodium fluoride, are volatilized in the presence of water or steam according to the following reaction scheme, and thereby converted into the gaseous phase:

$$2NaF+H_2O \rightarrow Na_2O+2HF$$

$$Na_2O+C \rightarrow 2Na+CO$$

$$Na_2O+CO \rightarrow 2Na+CO_2$$

Elementary sodium is gaseous, and is removed via the central gas vent, before condensation on colder filling material wandering downward through the furnace causes circuits to form in the shaft furnace. In the gaseous phase, which also contains hydrofluoric acid (HF), sodium fluoride is again formed, and can be separated out during the ensuing waste gas treatment.

Another option for removing fluorides is to react them with silicon dioxide as follows:

$$SiO_2+4NaF \rightarrow SiF_4+2Na_2O.$$

In a preferred embodiment, the method according to the invention is implemented in such a way as to blow oxygen and water or steam into the shaft furnace by lances. This measure deals with a problem where, when oxygen or water/steam are only blown in through nozzles that empty at the wall of the shaft furnace, just the border areas of the shaft furnace or the carbon fill in the shaft furnace are supplied, while the interior region of the carbon fill cross section remains undersupplied, as a result of which the reaction rate is very low in these areas, or it might be impossible to achieve an autothermal process at all. By introducing oxygen and water/steam with the help of lances, the mentioned substances can be introduced precisely to those locations lying in the area of inductive heating, thereby generating reaction spaces that are hot enough for the process to subsequently run its course autothermally along the entire shaft furnace. At this juncture, it is also possible to blow in powdery or dusty used carbon-containing cathode material, in particular cathode troughs.

If the carbon of the used cathode material is not completely gassed in the shaft furnace, the method can preferably be developed further by dissolving the non-gassed carbon in an iron bath. The iron bath can here be inductively heated, for example. The iron bath ensures outstanding dissolution kinetics for carbon, and is easy to regenerate by blowing in oxygen, so-called refining. Since this refining is an exothermal reaction, the thermal balance of the method is improved in this way. The oxygen can also be blown in continuously, so as to keep the iron bath constantly C-undersaturated.

In a further development of the inventive idea, it is proposed within the framework of an especially preferred embodiment of the present invention that an additive be incorporated into the used carbon-containing cathode material during or before its introduction into the shaft furnace in order to slag refractory material, i.e., as described above, in particular aluminum, silicon and magnesium oxide, which are present in the used carbon-containing cathode material as residues of the refractory lining. Possible additives include elementary calcium and all calcium-containing compounds, which are also referred to below as Ca carriers, elementary magnesium as well as all magnesium-containing compounds, which are also referred to below as Mg carriers. Examples of suitable Ca carriers are CaO and $CaCO_3$, e.g., which are available in the form of steel mill slag, limestone or anhydrous lime, and preferably introduced into the process in coarse pieces to ensure that the carbon fill or column can always be thoroughly gassed. Examples of suitable Mg carriers are MgO and $MgCO_3$, which are also preferably introduced into the process in coarse pieces to ensure that the carbon fill or column can always be thoroughly gassed. In this embodiment, the reaction between the additive, i.e., preferably the Ca carrier or Mg carrier, and the aluminum, silicon and magnesium oxides of the refractory material can yield high quality slag, specifically, when adding Ca carriers, high quality calcium aluminate slag, which exhibit outstanding hydraulic properties, and can thus be advantageously used in the cement industry for manufacturing hydraulic binders. The addition of Mg carriers produces high quality magnesium aluminate slag or spinel slag, for example which can be used as refractory concrete.

In the aforementioned embodiment, as much Ca carrier and especially preferably calcium oxide is added to the used carbon-containing cathode material during or before its introduction into the shaft furnace to ensure that a calcium aluminate slag with an $Al_2O_3$ content of 50 to 70%, preferably 55 to 65% w/w, and especially preferably about 60% w/w, is generated in the shaft furnace. A melt phase here arises at under 1,600° C. As an alternative thereto, it is equally preferred that as much Ca carrier and especially preferably calcium oxide be added to the used carbon-containing cathode material during or before its introduction into the shaft furnace to ensure that a calcium aluminate slag with an $Al_2O_3$ content of more than 70 to 90% w/w, preferably 75 to 85% w/w, and especially preferably about 80% w/w, is generated in the shaft furnace. The high melting point of the slag here gives rise to a sintering phase. In light of their composition and quality, these calcium aluminates are suited in particular for use in generating quick cements, increasing the early strength of composite elements, or in the form of sulfate-induced slag cements or gypsum-slag cements. Therefore, the use of these calcium aluminates in cements is especially advantageous, since it enables a significant reduction in the clinker factor during cement production, i.e., in the percentage of Portland cement clinkers per ton of cement. This is advantageous in terms of climate policy, because roughly 1 ton of carbon dioxide is produced during the manufacture of 1 ton of Portland cement clinkers. Furthermore, the calcium aluminates fabricated in this way can be used for manufacturing refractory materials and manufacturing ⅓ slag, i.e., a mixture comprised of $CaF_2$, $Al_2O_3$ and CaO, which in turn is employed for obtaining heavy-duty steel components. Aside from the above, the calcium aluminates fabricated in this way can also be used in the area of pig iron desulphurization or secondary metallurgy, which is also advantageous among other things since it avoids the problematic use of calcium fluoride.

The method according to the invention preferably employs used carbon-containing cathode material with an aluminum oxide content of 10 to 45%, especially preferably of 15 to 30%.

The aforementioned embodiment, in which an additive is incorporated into the used carbon-containing cathode material during or before its introduction into the shaft furnace, can also be combined with the embodiment in which the carbon of the used carbon-containing cathode material is not completely gassed, and the carbon that was not gassed is dissolved in an iron bath.

However, as an alternative to executing the process with an iron bath, the method can also be implemented in such a way according to another preferred embodiment as to completely gas the carbon in the cathode material and remove the remaining calcinate. In this case as well, an additive, especially preferably a Ca carrier and/or Mg carrier, can, but does not have to, be incorporated in the used carbon-containing cathode material during or before its introduction into the shaft furnace. If no additive is incorporated, a dry, practically carbon-free calcinate made up of aluminum and silicon oxide is discharged, which can also find application in the cement industry.

It was observed that incomplete calcinate can disintegrate into carbon-containing powder. However, in light of the powder form, the latter is then no longer permeable to gas, and the corresponding shaft furnace section can no longer be thoroughly gassed. The following after-treatment options are conceivable. After-treatment can take place in the iron bath as described above. Alternatively, the powder can be treated with steam for decarbonization purposes, as a result of which a simultaneous cooling is achieved due to the endothermic, heterogeneous water-gas reaction.

As already indicated further above, elementary sodium along with sodium oxide ($Na_2O$) recombines in the gaseous phase in the presence of hydrofluoric acid (HF) to sodium fluoride (NaF). For sodium oxide, the reaction equation is to be written out as follows:

$$Na_2O+2HF \rightarrow 2NaF+H_2O.$$

For the gaseous sodium, the reaction equation must here be written out as follows:

$$Na+HF \rightarrow NaF+\tfrac{1}{2}H_2$$

The following secondary reaction can be observed:

$$2Na+H_2O \rightarrow Na_2O+H_2$$

If the objective is now to obtain problematic, but economically interesting hydrofluoric acid in the gaseous phase, the method is preferably implemented using a strongly acidic slag. Given the presence of a strongly acidic slag, wherein the acid component can be formed by silicon oxide and/or aluminum oxide, for example, hydrofluoric acid is regenerated according to the following reaction equation:

$$2NaF+SiO_2+H_2O \rightarrow Na_2SiO_3+2HF$$

or $$NaF+Al_2O_3+H_2O \rightarrow NaAl_2O_4+HF.$$

In order to control the products obtained in the gaseous phase as respectively desired, the method is thus preferably further developed in such a way that the basicity in the shaft furnace can be adjusted by adding basic or acidic ingredients, in particular CaO or $SiO_2$.

An especially preferred process provides for the alternating addition of basic and acidic ingredients. In this way, sodium fluoride and hydrofluoric acid are alternately obtained. The hydrofluoric acid can be reacted with alumina ($Al_2O_3$) to form aluminum fluoride ($AlF_3$) and water, wherein the aluminum fluoride can be further processed with the sodium fluoride (NaF) obtained during the basic process to form cryrolite ($Na_3AlF_6$), which in turn can be used in aluminum production according to the Hall-Heroult process.

$$12NaF+4AlF_3 \rightarrow 4Na_3AlF_6$$

If the load of toxic substances, such as cyanides, alkali metals and their fluorides, is too high, it may happen that the carbon of the used cathode material will not be coupled through electric induction when exposed to heating as described above. In this case, it is preferred that the method according to the invention be further developed in such a way as to also introduce unused graphite or coke to the carbon of the used cathode material. At a suitable frequency, the unused carbon is coupled to the induction field and heats up, wherein the actual carbon to be reprocessed is also brought to temperature through contact with the incandescent graphite or coke.

The method is preferably implemented in such a way that the reaction gases are drawn at a temperature of 800° C. to 1200° C., in particular 900° C. to 1100° C., especially 1000° C., and relayed to after-treatment, thereby preventing a condensation of reaction gases or toxic substances in the line systems, and ensuring a controlled waste gas treatment.

The maximum temperature in the furnace hearth here preferably measures 1,200 to 1,700° C., especially preferably 1,400 to 1,700° C., and eminently preferably 1,500 to 1,600° C. This maximum temperature is diminished up to the central gas vent by endothermic reactions and heat losses to a maximum of 1,200° C.

In a further development of the inventive idea, it is proposed that the after-treatment of the reaction gas drawn from the shaft furnace take the form of a waste gas treatment free of wastewater. For example, this can take place by routing reaction gas drawn from the shaft furnace, which aside from carbon monoxide, carbon dioxide, hydrogen, possibly water, and dust discharged from the reactor, also contains volatilized compounds, including in particular hydrofluoric acid, sodium fluoride, aluminum fluoride and others, into a cooled and preferably isothermally operated fluidized bed reactor, which contains particles comprised of aluminum oxide, sodium fluoride, aluminum fluoride, calcium carbonate, aluminum hydroxide or the like. The temperature of the fluidized bed can here be easily set to a suitable value, for example by a water-powered heat exchanger or a water evaporator, wherein the strong turbulence of the fluidized bed ensures a uniform temperature in the shaft furnace, for example of about 1,000° C., about 1,100° C. or about 1,200° C. The volatilized compounds of the waste gas are quickly cooled, condensed and possibly reacted on the fluidized aluminum oxide particles, as a result of which cryolite or similar compounds form on the aluminum oxide particles. Waste gas cleaned in this way is drawn from the fluidized bed reactor, wherein any remaining aluminum oxide particles loaded with reaction products are separated out of the waste gas in a cyclone situated downstream from the reactor, or in another dry absorption process on alumina or aluminum oxide in a counter-current at a low temperature. Silicon fluoride ($SiF_4$) can optionally also be separated out of the waste gas obtained in this way. Aside from being free of waste water, this after-treatment has the advantage of requiring only comparatively small devices. Another advantage to this after-treatment is that heat is generated in the process, which can be used to heat up the process steam required for the shaft furnace. In addition, the product comprised of the particles and waste gas can be used in aluminum production.

Other features which are considered as characteristic for the invention are set forth in the appended claims.

Although the invention is illustrated and described herein as embodied in a method for processing used carbon-containing a cathode material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
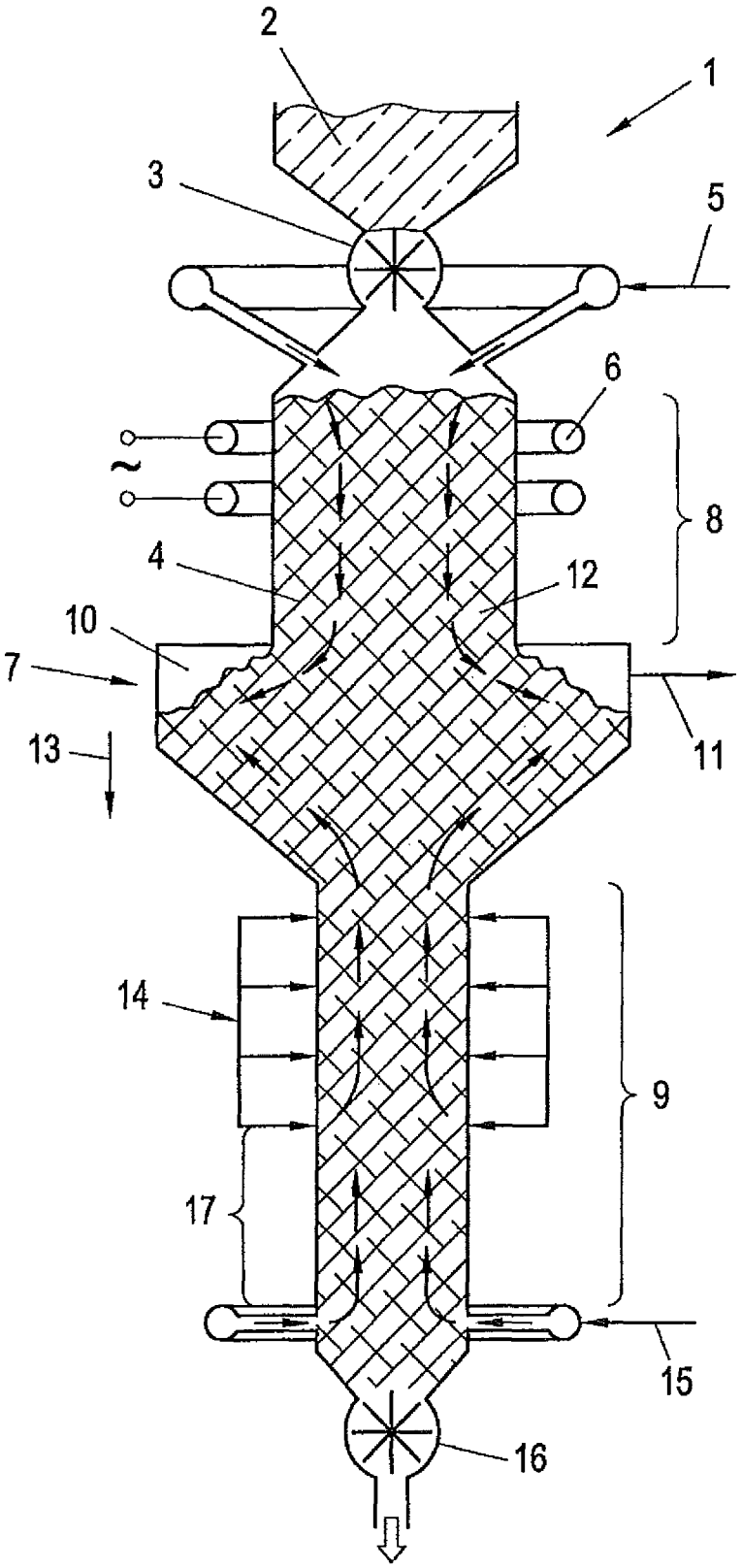
FIG. 1 is a schematic view of a shaft furnace suitable for implementing the method according to the invention based on a first exemplary embodiment.

Referring now to the figures of the drawings in detail and first, particularly to FIG. 1 thereof, there is shown a shaft furnace 1 and while implementing the method according to the invention at inlet 2, has placed in it used, crushed cathode troughs, which are also referred to as spent potliners. The carbon pieces are brought into a shaft 4 of the shaft furnace 1 by a rotary valve 3, wherein oxygen can already be introduced up to a height of the rotary valve 3 via a ring line 5. Induction loops 6 are used to introduce an induction field in the cross section of the shaft furnace 1, so that the carbon of the used cathode troughs is coupled, and heated up to an ignition temperature of 600° C. to 800° C., for example. In region 7 of the shaft furnace 1, the shaft 4 exhibits an enlarged diameter by comparison to a first axial longitudinal section 8 and second axial longitudinal section 9, so that the reaction gases can be drawn from an annular space 10, as symbolized by arrow 11. As already described, the reaction gases contain carbon monoxide, carbon dioxide, sodium fluoride, sodium, nitrogen, hydrofluoric acid, hydrogen and possibly beryllium fluoride as primary components. Because the carbon of the used cathode troughs is expended by the gassing reaction, the carbon column or fill 12 present in the shaft furnace 1, which after all is comprised of the carbon of the used cathode material, drops off in the direction of arrow 13. Since the reaction gases in region 7 are drawn from the annular space 10, the reaction gases are conducted co-currently with the carbon in the first longitudinal section 8, and counter-currently to the carbon in the second longitudinal section 9 of the shaft furnace. The counter-current process is preferably kinetically imbalanced relative to the Boudouard reaction, thereby maximizing the percentage of carbon dioxide in the waste gas, so that only a short counter-current fill is required. Aside from the ring line 5 for supplying oxygen and/or water/steam in the upper region of the shaft furnace, additional nozzles 14 are secured to the second longitudinal section 9 of the shaft furnace, through which oxygen and/or water/steam can also be blown in. Additional nozzles having the same functionality are located in position 15. Another rotary valve is marked 16, and can be used to discharge calcinate.

While the upper portion of the second longitudinal section 9 exhibiting the nozzles 14 represents a counter-current heating section, a lower region 17 must be understood as a cooling section, since nozzles 15 are intended for introducing primarily water in liquid form, and possibly as steam or wet steam.

Figure 2:
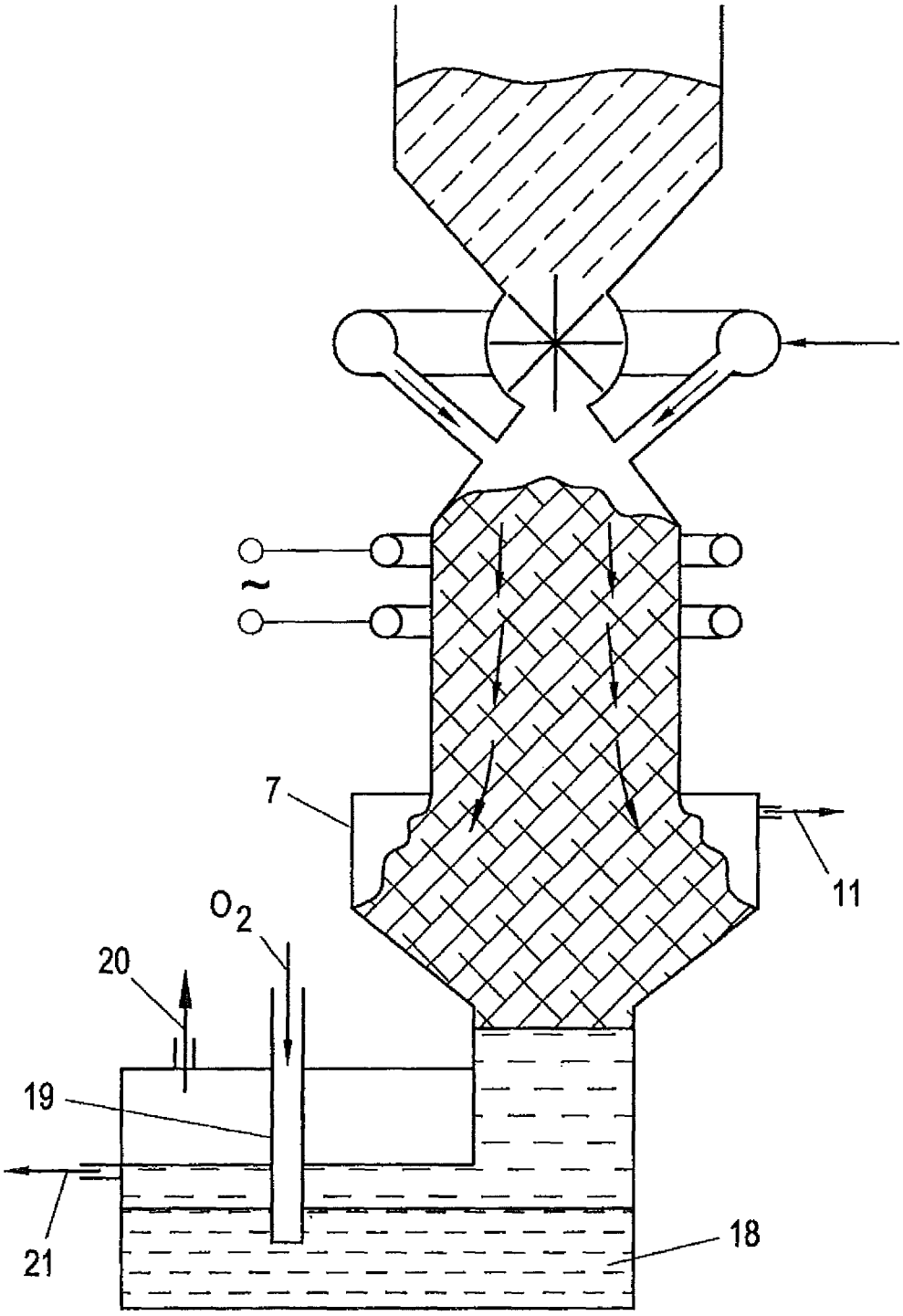
FIG. 2 is a schematic view of the shaft furnace with an iron bath suitable for implementing the method according to the invention based on a second exemplary embodiment.

FIG. 2 shows a second alternative to the process depicted on FIG. 1. While the carbon is to be completely gassed on FIG. 1, any carbon that has not been gassed can be dissolved in an iron bath 18 in the process according to FIG. 2. Otherwise, the shaft furnace has essentially the same structural configuration, and in particular also exhibits the region 7 with an enlarged diameter, from which the waste gases can be drawn at arrow 11. If the iron bath 18 has been saturated with carbon, oxygen is blown into the iron bath 18 via a lance 19, so that pure carbon monoxide escapes at outlet 20, and can subsequently be thermally utilized. Fluoride-free slag can be tapped at outlet 21, and relayed for use in the cement industry.

Figure 3:
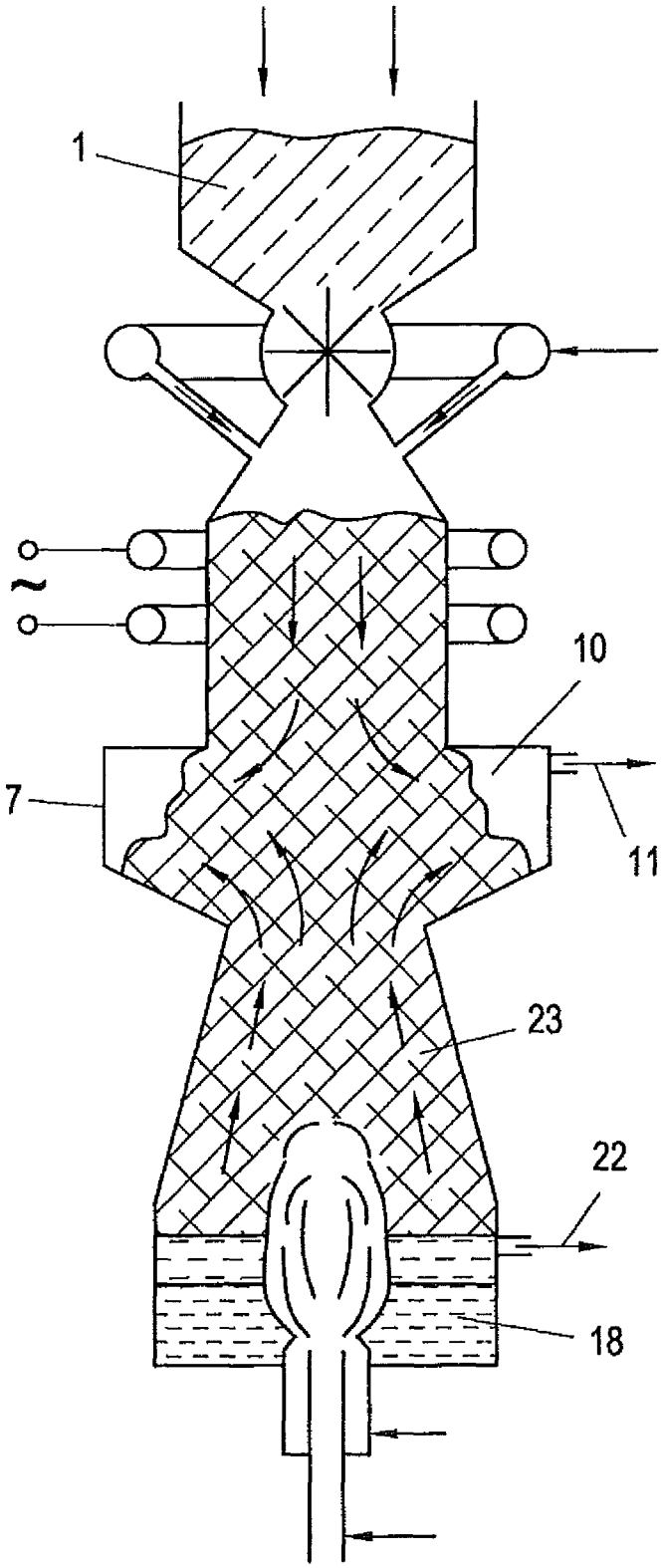
FIG. 3 is a schematic view of the shaft furnace with the iron bath suitable for implementing the method according to the invention based on a third exemplary embodiment.

In the third alternative configuration of the shaft furnace according to FIG. 3, the iron bath 18 is arranged in the shaft furnace 1, wherein slag is tapped from the fluoride-free slag at outlet 22. Region 23 of the shaft furnace has a melting zone, in which iron is recarburized. As in the preceding examples, the reaction gas is drawn out of an annular space 10 from the region 7 with an enlarged diameter at position 11.

Figure 4:
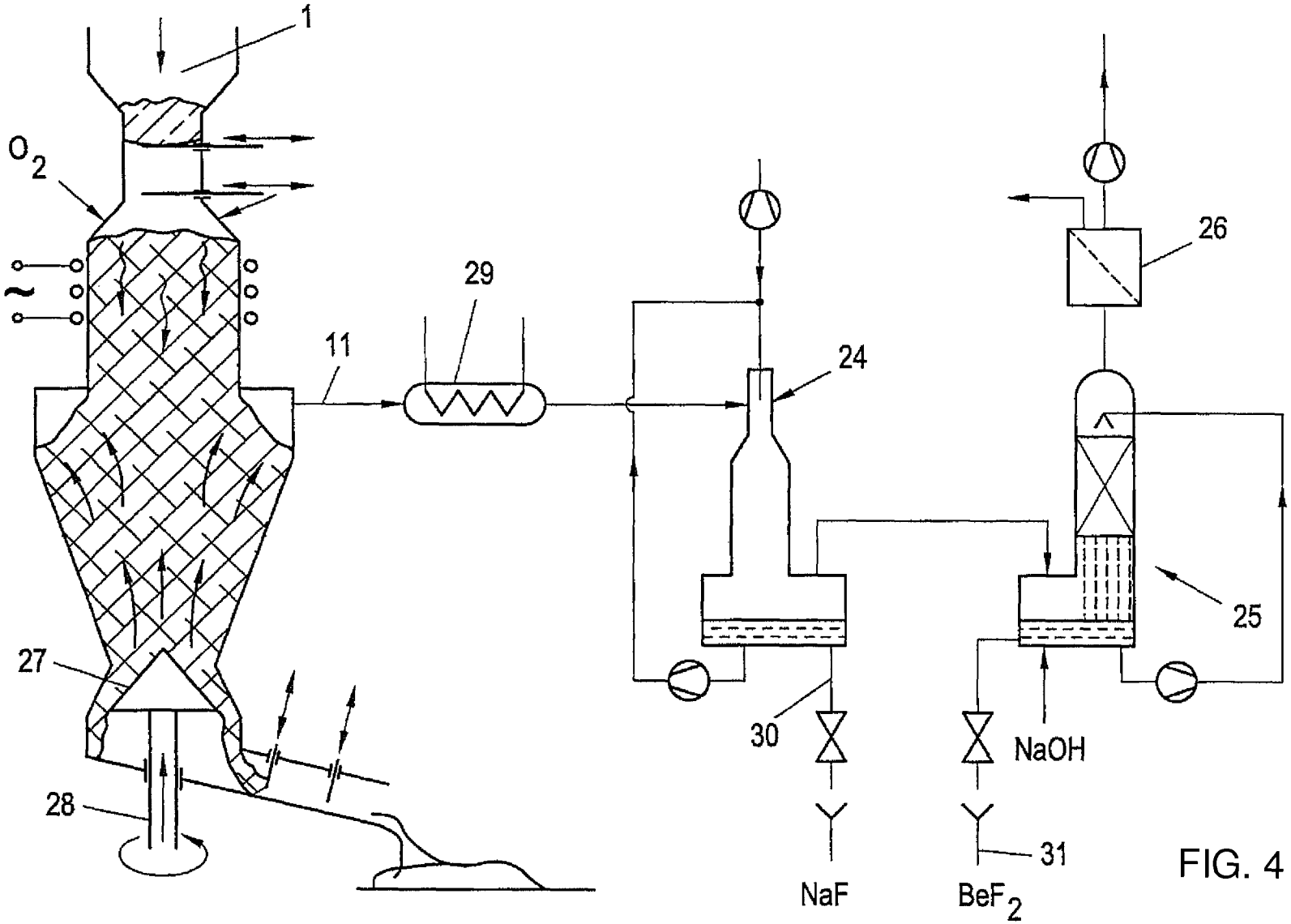
FIG. 4 is a schematic view of an overall system suitable for implementing the method according to the invention.

As may be gleaned from FIG. 4, the system for reprocessing the used cathode troughs is comprised of a quench 24, caustic soda absorber 25 and aerosol demister 26 to go along with the shaft furnace 1. The shaft furnace 1 exhibits the already described features, wherein discharge in this case does not take place via a rotary valve, but rather via a rotating cone 27, which is hollow and can be charged with steam, for example, by way of line 28, so that the cone 27 releases steam into an interior of the carbon fill like a lance. The reaction gases are again drawn at position 11, wherein the gases are fed into a gas cooler 29 in a first step before getting into the quench 24. They are there reacted with water in aerosol form and depressurized. Sodium fluoride can then be drawn at line 30. The hydrofluoric acid is neutralized by caustic soda in the caustic soda absorber 25. Beryllium fluoride can be drawn from the caustic soda absorber 25 at output 31. In the aerosol demister 26, residual sodium fluoride and beryllium fluoride are separated out of the gas stream, which subsequently represents a pure synthesis gas containing carbon monoxide and hydrogen.

Figure 5:
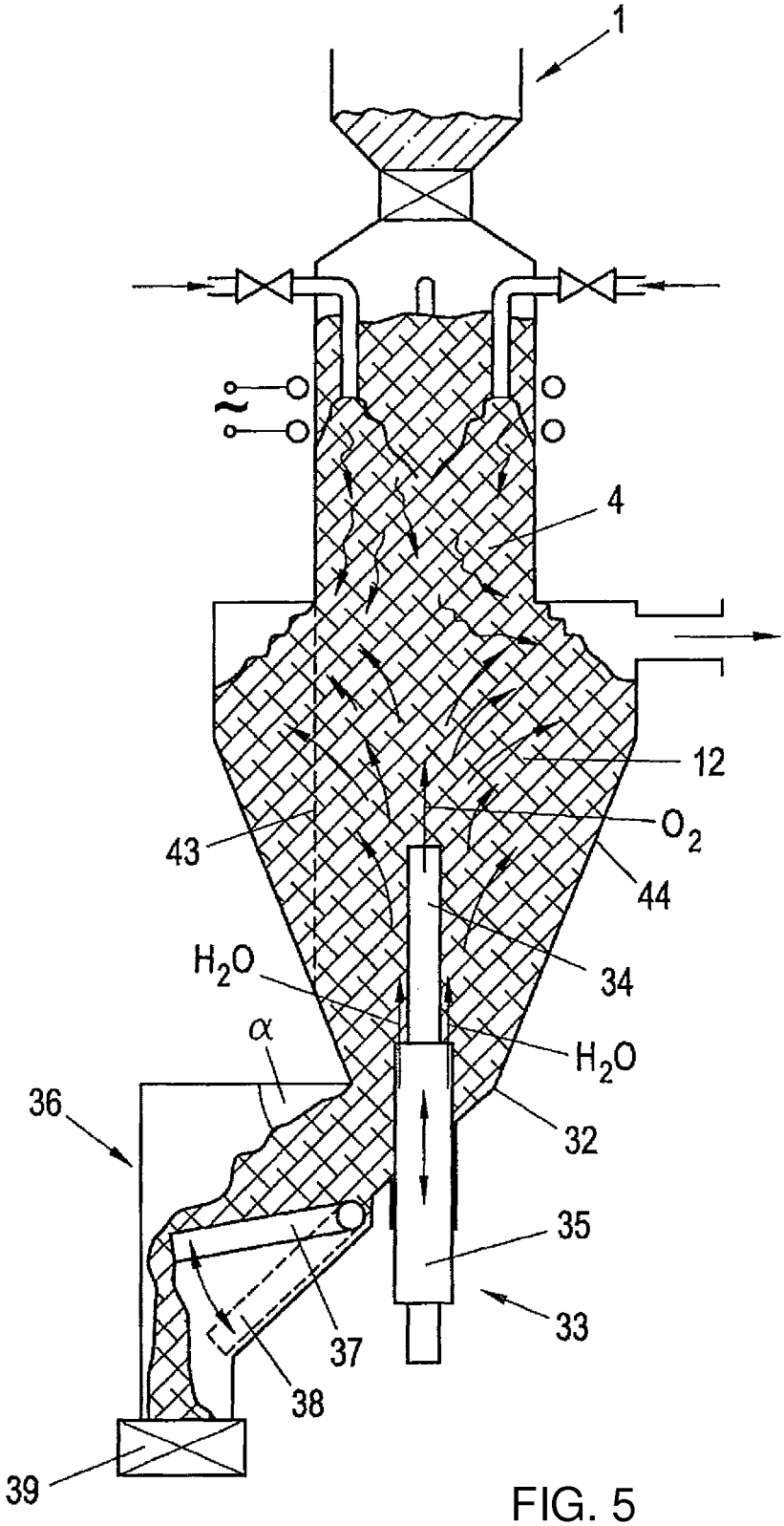
FIG. 5 is a schematic view of the shaft furnace suitable for implementing the method according to the invention based on a fourth exemplary embodiment.

As evident from FIG. 5, a lance 33 comprised of an internal pipe 34 and external pipe 35 empties into the lower end 32 of the shaft 4 of the shaft furnace 1. The two pipes 34 and 35 can be displaced or telescoped relative to the shaft furnace and each other, wherein oxygen is introduced into the shaft 4 of the shaft furnace 1 through the internal pipe, and water/steam through the external pipe, for example. Because the lance 33 can be displaced relative to the shaft, the fill 12 in the shaft 4 of the shaft furnace 1 can be mechanically manipulated, thereby breaking mechanical bridges and ensuring discharge in region 36. Secured in region 36 is a pivoting flap 37, upon which the calcinate comes to lie at a natural dumping angle $\alpha$. Once the dumping angle has been reached, no further discharge of calcinate from the shaft 4 takes place, which in this case causes the flap 37 to pivot into the position 38 denoted with dashed lines, so that the calcinate falls into a discharge sluice 39. The flap 37 is thereupon lifted once more to again gather calcinate.

As further depicted based on the example of FIG. 5, the shaft furnace 1 can generally also exhibit a rectangular cross section instead of a circular cross section. This is represented on FIG. 5 by wall 43 denoted by dashed lines, wherein at least sections of both the first longitudinal section and second longitudinal section can exhibit a rectangular cross section. A clear width of 600 to 800 mm has here proven beneficial. In order to realize the enlarged cross section required for the central gas vent, the second longitudinal section of the shaft furnace exhibits wall 44 shown on the right of FIG. 5, which expands toward the discharge opening.

Figure 6:
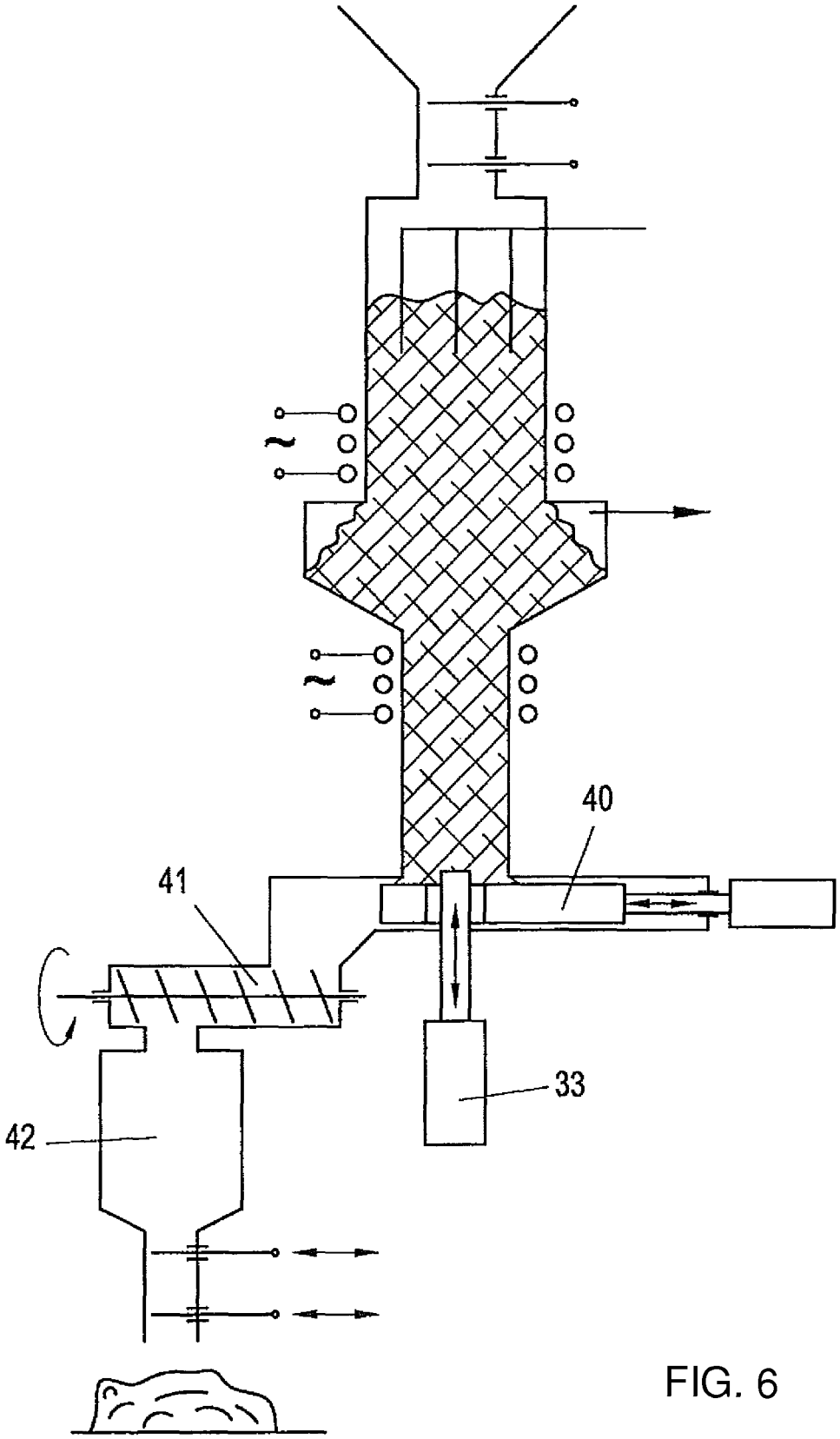
FIG. 6 is a schematic view of the shaft furnace suitable for implementing the method according to the invention based on a fifth exemplary embodiment.

FIG. 6 depicts a fifth alternative embodiment, in which the calcinate is conveyed by a vibrating floor 40 in the direction of a screw conveyor 41, so as to in this way also be routed to a discharge sluice 42. The vibrating floor 40 here exhibits an opening for a lance 33.

Figure 7:
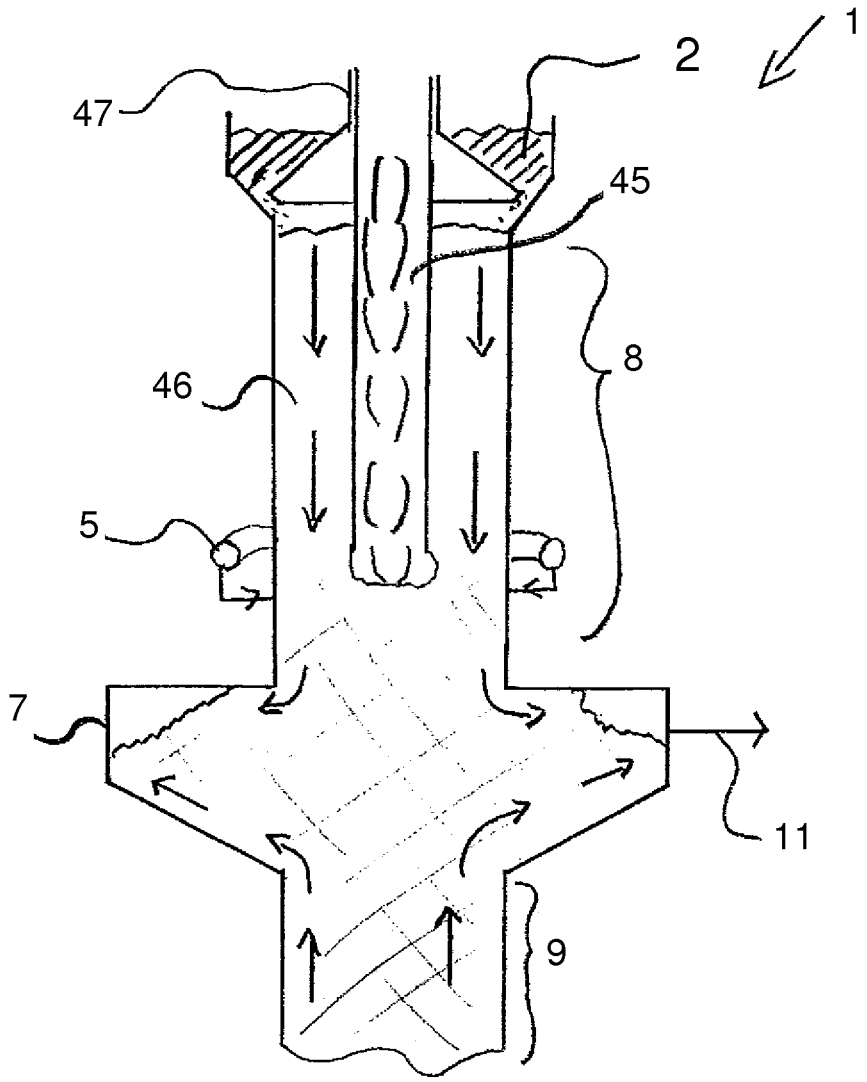
FIG. 7 is a schematic view of an upper partial piece of the shaft furnace suitable for implementing the method according to the invention with fossil heating based on a sixth exemplary embodiment.

FIG. 7 presents the upper partial piece of the shaft furnace 1 according to a sixth alternative embodiment, in which the starting material, i.e., the carbon of the used cathode material, is heated to the reaction temperature not via an induction heater encompassing an induction loop, but rather through fossil firing, contrary to the embodiments shown on FIGS. 1 to 6. To this end, the first, upper longitudinal section 8 of the shaft furnace 1 incorporates a combustion chamber 45, by way of which fuel, such as natural gas, is supplied to the shaft furnace 1 during its operation. In addition, the ring line 5 leading around the shaft furnace 1 is arranged in the lower region of the first, upper longitudinal section 8 of the shaft furnace 1 at the height of the lower end of the combustion chamber 45, through which oxygen for burning the fuel and gassing the carbon is supplied to the shaft furnace 1. Also provided above the annular shaft 46 separated out of the first, upper longitudinal section 8 by the combustion chamber 45 is a discharge region 2, by way of which the shaft furnace is supplied with a mixture of crushed, used cathode troughs and additive(s), specifically and preferably calcium oxide. For metering purposes, this region of the shaft furnace 1 accommodates a double-bell sluice 47, whose upper part can be displaced in a vertical direction so as to open or close the sluice 47. With the shaft furnace 1 in operation, the mixture of crushed, used cathode troughs and calcium oxide hence passes via the double-bell sluice 47 from the discharge region 2 into the annular shaft 46, in which this mixture encounters the already heated carbon fill. The lower region of the shaft furnace not depicted on FIG. 7 can be configured as in any of the embodiments shown on FIGS. 1 to 6. The shaft furnace 1 in this embodiment is preferably operated in such a way as to draw reaction gas with a temperature of about 1,200° C. at the gas position 11. As an alternative to the procedure described above, a mixture of fuel and oxidation gas can also be added to the shaft furnace 1 via the combustion chamber 45, and water or steam, possibly mixed in with oxygen or air, can be introduced through the ring line 5.

Figure 8:
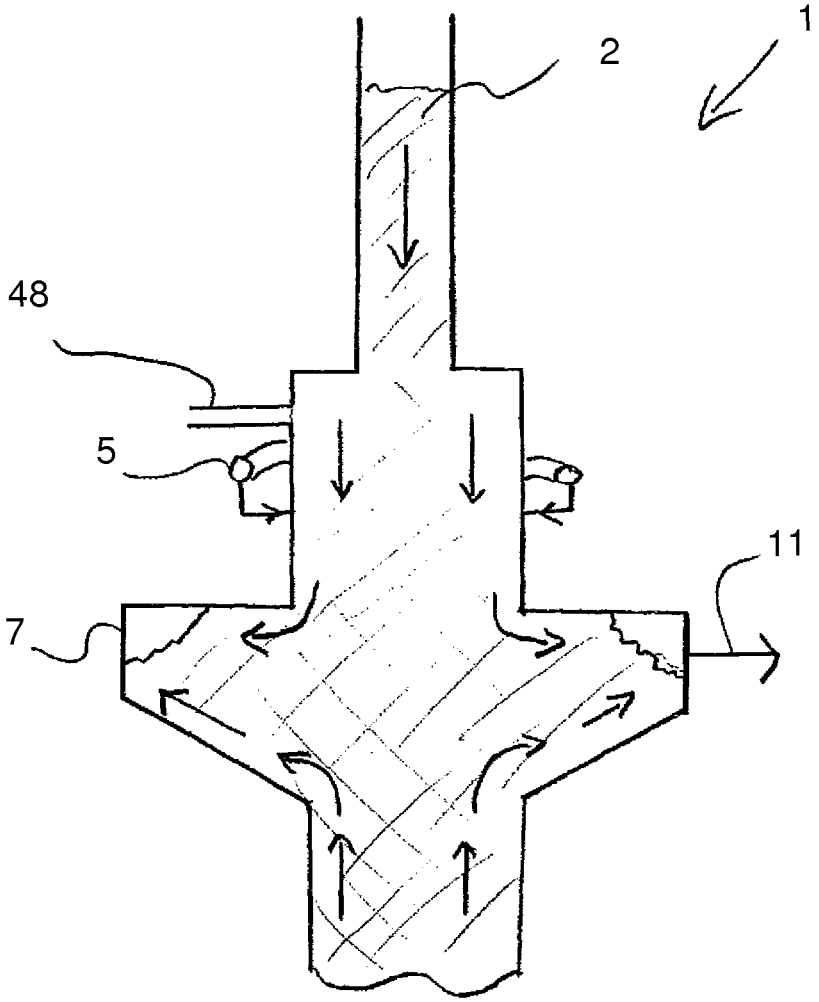
FIG. 8 is a schematic view of the upper partial piece of the shaft furnace suitable for implementing the method according to the invention with the fossil heating based on a seventh exemplary embodiment.

FIG. 8 presents a seventh alternative embodiment to the one depicted on FIG. 7, in which the shaft furnace 1 is also fossil fired. Instead of the combustion chamber 45 provided in the shaft furnace 1 on FIG. 7, the shaft furnace 1 on FIG. 8 incorporates a fuel supply line 48 for introducing the fuel in the upper region of its first, upper longitudinal section, through which the shaft furnace 1 is supplied with fuel, in particular natural gas, or a mixture of fuel and oxidation gas, such as oxygen or air. If only fuel is fed to the shaft furnace 1 via the fuel supply line 48, an oxidation gas is fed to the shaft furnace 1 via the ring line 5. In particular if a mixture of fuel and oxidation gas is fed to the shaft furnace 1 via the fuel supply line 48, water or steam, possibly mixed with oxygen or air, can be fed to the shaft furnace 1 via the ring line 5. The shaft furnace 1 is charged by way of the discharge region 2, which for metering purposes can optionally exhibit a rotary valve configured as shown on FIG. 1. The lower region of the shaft furnace not shown on FIG. 8 can be configured just like any of the embodiments depicted on FIGS. 1 to 6.

Figure 9:
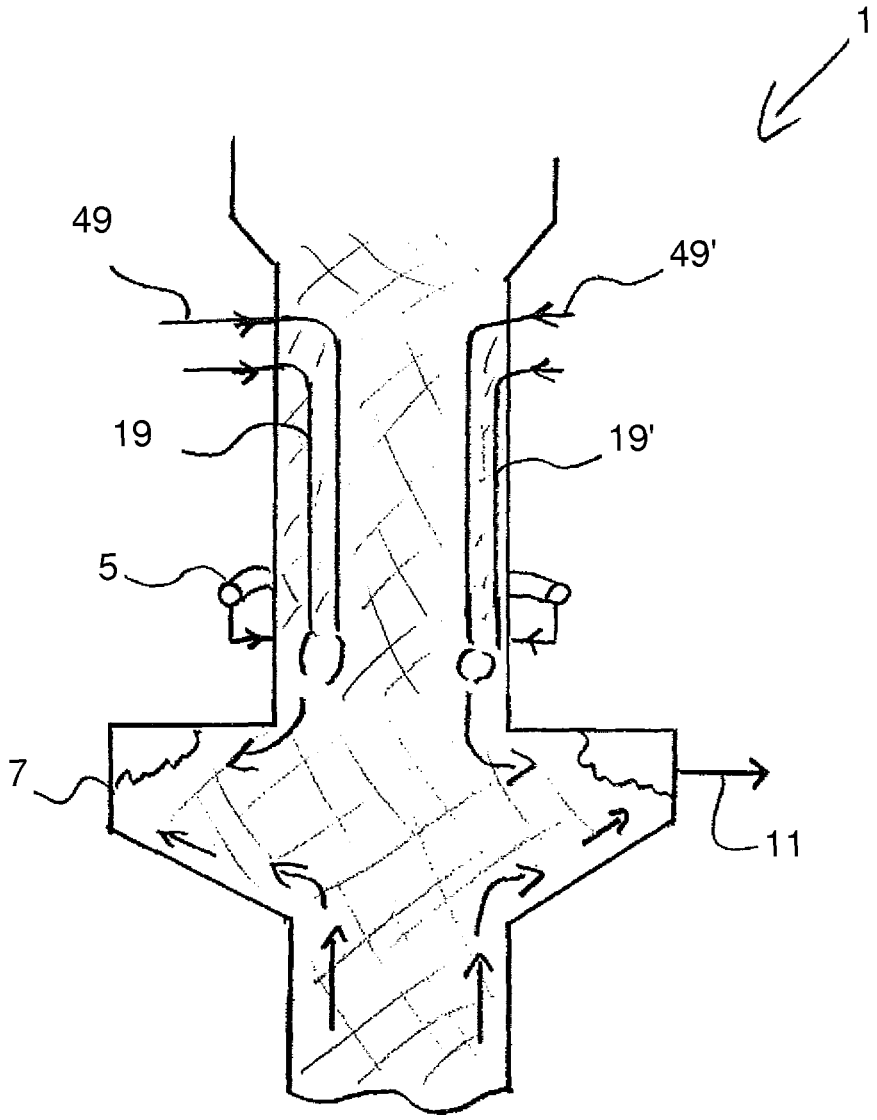
FIG. 9 is a schematic view of the upper partial piece of the shaft furnace suitable for implementing the method according to the invention with the fossil heating based on an eighth exemplary embodiment.

FIG. 9 presents an alternative embodiment to the ones depicted on FIGS. 7 and 8, in which the shaft furnace 1 is also fossil fired. Provided instead of the combustion chamber 45 shown on FIG. 7 or the fuel supply line 48 shown on FIG. 8 in the upper region of the shaft furnace 1 on FIG. 9 for purposes of introducing the fuel are lances 19, 19' extending in the longitudinal direction of the shaft furnace 1, through which oxygen is supplied to the shaft furnace 1, and lances 49, 49', through which fuel is supplied to the shaft furnace 1. These lances are uniformly arranged concentrically around the longitudinal axis of the shaft furnace 1. A ring line 5 is again provided, through which the shaft furnace 1 can be supplied with oxygen or air and/or water/steam. The lower region of the shaft furnace not shown on FIG. 9 can be configured like any of the embodiments depicted on FIGS. 1 to 6.

The invention claimed is:

1. A method for processing used carbon-containing cathode material, which comprises the steps of:

placing the used carbon-containing cathode material in a shaft furnace;

subjected the used carbon-containing cathode material, in order to gasify carbon, to a thermal treatment in the shaft furnace at a temperature above an ignition temperature of the carbon and above an evaporation temperature of toxic substances contained in the used carbon-containing cathode material;

conducting reaction gases co-currently with the carbon in a first longitudinal section of the shaft furnace, and counter-currently to the carbon in a second longitudinal section of the shaft furnace; and drawing the reaction gases from a region of the shaft furnace having an enlarged cross section between the first and second longitudinal sections.

2. The method according to claim 1, which further comprises subjecting the reaction gases to an after-treatment after being drawn from the shaft furnace.

3. The method according to claim 1, which further comprises setting a length of the first longitudinal section to measure 40 to 80% of an overall length of the shaft furnace.

4. The method according to claim 1, which further comprises setting a length of the second longitudinal section to measure 20 to 60% of an overall length of the shaft furnace.

5. The method according to claim 1, which further comprises introducing energy for the thermal treatment into the carbon to be reprocessed via electric induction.

6. The method according to claim 1, which further comprises heating the shaft furnace through fossil firing.

7. The method according to claim 6, which further comprises introducing fuel or a mixture of fuel and oxidation gas into the shaft furnace by one of a combustion chamber situated in an upper region of the first longitudinal section, a supply line that empties in the upper region of the first longitudinal section or at least one lance disposed in the upper region of the first longitudinal section.

8. The method according to claim 1, which further comprises blowing oxygen into at least one of the first or second longitudinal sections of the shaft furnace.

9. The method according to claim 1, which further comprises blowing water or steam into at least one of the first or second longitudinal sections of the shaft furnace.

10. The method according to claim 1, which further comprises blowing oxygen and water/steam into the shaft furnace with the help of lances.

11. The method according to claim 1, which further comprises dissolving non-gassed carbon in an iron bath.

12. The method according to claim 1, which further comprises incorporating an additive into the used carbon-containing cathode material during or before its introduction into the shaft furnace in order to slag refractory material.

13. The method according to claim 12, which further comprises providing at least one of a calcium compound or a magnesium compound as the additive.

14. The method according to claim 1, which further comprises completely gassing out the carbon of the used carbon-containing cathode material and discharging remaining calcinate.

15. The method according to claim 1, which further comprises adjusting a basicity in the shaft furnace by adding basic or acidic ingredients.

16. The method according to claim 15, which further comprises introducing alternatively the basic ingredients and the acidic ingredients.

17. The method according to claim 1, which further comprises introducing unused graphite or coke in addition to the carbon of the used carbon-containing cathode material.

18. The method according to claim 2, which further comprises drawing off the reaction gases at a temperature of 800° C. to 1200° C. and relaying the reaction gases to the after-treatment.

19. The method according to claim 1, which further comprises:

routing the reaction gases drawn from the shaft furnace into a cooled and isothermally operated fluidized bed reactor, which contains particles comprised of aluminum oxide; and drawing cleaned waste gas from the fluidized bed reactor.

* * * * *